US008287422B2

(12) United States Patent
Tseng

(10) Patent No.: US 8,287,422 B2
(45) Date of Patent: Oct. 16, 2012

(54) MODEL HELICOPTER WITH EPICYCLIC GEARING BASED REDUCTION GEAR MECHANISM

(76) Inventor: Shu-Mei Tseng, Taipei (TW)

( * ) Notice: Subject to any disclaimer, the term of this patent is extended or adjusted under 35 U.S.C. 154(b) by 404 days.

(21) Appl. No.: 12/779,960

(22) Filed: May 14, 2010

(65) Prior Publication Data

US 2011/0281683 A1 Nov. 17, 2011

(51) Int. Cl.
*F16H 57/08* (2006.01)

(52) U.S. Cl. ..... 475/331

(58) Field of Classification Search ..... 475/338, 475/339, 340

See application file for complete search history.

(56) References Cited

U.S. PATENT DOCUMENTS 6,931,959 B2 * 8/2005 Giuriati ..... 74/413
6,966,865 B2 * 11/2005 Drago et al. ..... 475/338
2004/0259678 A1 * 12/2004 Stille et al. ..... 475/331

* cited by examiner

*Primary Examiner* — Edwin A Young

(57) ABSTRACT

A model helicopter includes a drive mechanism, the drive mechanism comprising a battery powered motor comprising a toothed motor shaft; a main rotor comprising a main shaft aligned with the motor shaft, the main shaft including a main gear; and a reduction gear assembly comprising four lower first gears arranged around the motor shaft, a lower outer ring gear meshed with the first gears, four lower second gears each being smaller than the first gear and fixed to top of the first gear, four upper third gears, an upper outer ring gear meshed with the third gears, four upper fourth gears each being smaller than the third gear and fixed to top of the third gear, the fourth gears being meshed with the main gear, and four shafts each axially passing through the fourth gear, the third gear, the second gear, and the first gear.

2 Claims, 4 Drawing Sheets

MODEL HELICOPTER WITH EPICYCLIC GEARING BASED REDUCTION GEAR MECHANISM

BACKGROUND OF THE INVENTION

1. Field of Invention

The invention relates to radio-controlled helicopters and more particularly to a model helicopter having a motor with a motor shaft being coaxial with a main shaft of a main rotor by epicyclic gearing so as to achieve a desired gear reduction ratio.

2. Description of Related Art

Major components of a drive mechanism of a typical type of model helicopter are shown in FIGS. 1 and 2 and comprise a motor (e.g., battery powered servo motor) 10, a small gear 12 fixed to a motor shaft of the motor 10, a main gear 11 in mesh with the small gear 12, a main shaft 1 fixed to the main gear 11, and a main rotor 13 at a top of the main shaft 1 and co-rotated therewith.

It is understood that the more powerful of the motor 10 the larger of the main gear 11 will be (i.e., greater diameter). One type of model helicopter having a main gear 11 with a diameter of 120 mm is available. However, greater diameter of main gear is not desired since it can adversely affect maneuverability, shorten the useful life of components, and greatly consume energy.

The invention is intended to obviate the above drawbacks by providing a model helicopter having a motor with a motor shaft being coaxial with a main shaft of a main rotor.

SUMMARY OF THE INVENTION

It is therefore one object of the invention to provide a model helicopter includes a drive mechanism, the drive mechanism comprising a battery powered motor comprising a toothed motor shaft; a main rotor comprising a main shaft aligned with the motor shaft, the main shaft including a main gear; and a reduction gear assembly comprising four lower first gears arranged around the motor shaft, a lower outer ring gear meshed with the first gears, four lower second gears each being smaller than the first gear and fixed to top of the first gear, four upper third gears, an upper outer ring gear meshed with the third gears, four upper fourth gears each being smaller than the third gear and fixed to top of the third gear, the fourth gears being meshed with the main gear, and four shafts each axially passing through the fourth gear, the third gear, the second gear, and the first gear so that a revolution of the motor shaft rotates the main shaft via the first gears, the fourth gears, and the main gear.

The above and other objects, features and advantages of the invention will become apparent from the following detailed description taken with the accompanying drawings.

DETAILED DESCRIPTION OF THE INVENTION

Figure 1:
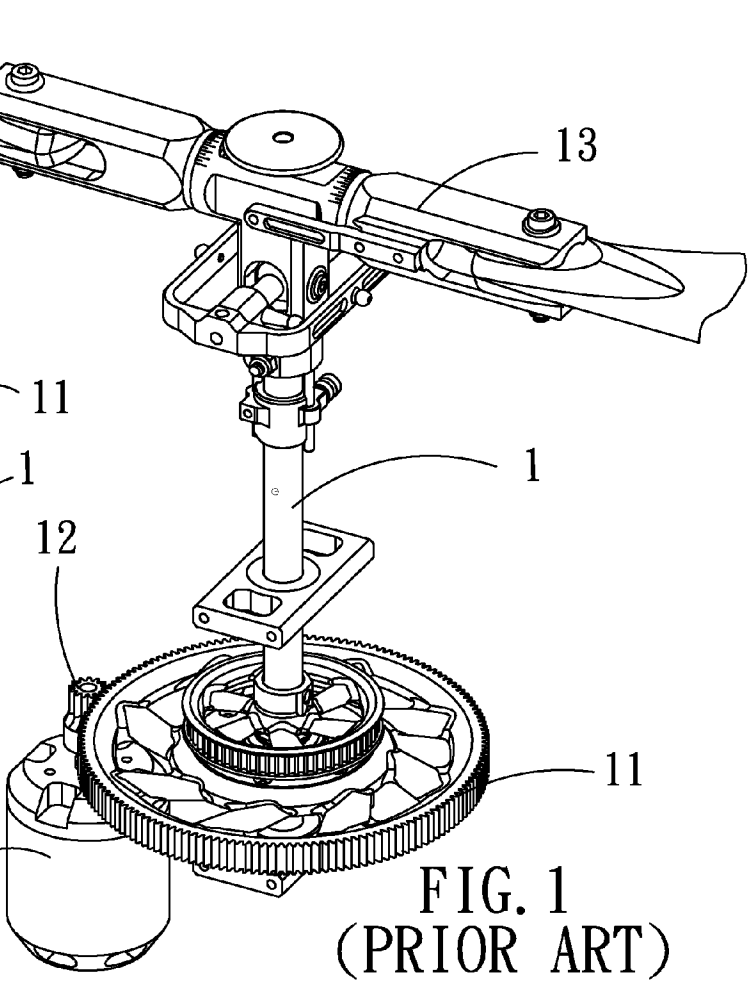
FIG. 1 (PRIOR ART)
FIG. 1 is a perspective view of major components of a drive mechanism of a typical model helicopter.
Figure 2:
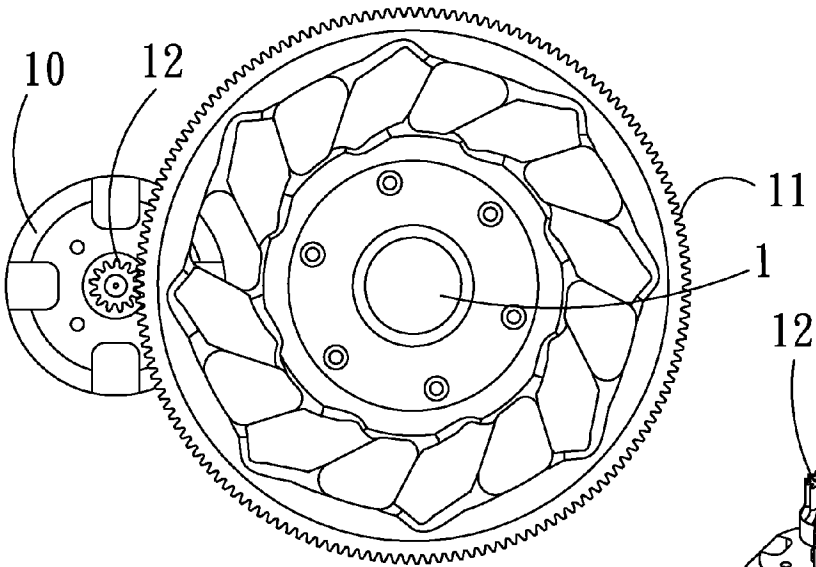
FIG. 2 (PRIOR ART)
FIG. 2 is a top plan view of FIG. 1 with the main rotor removed for clarity.
Figure 3:
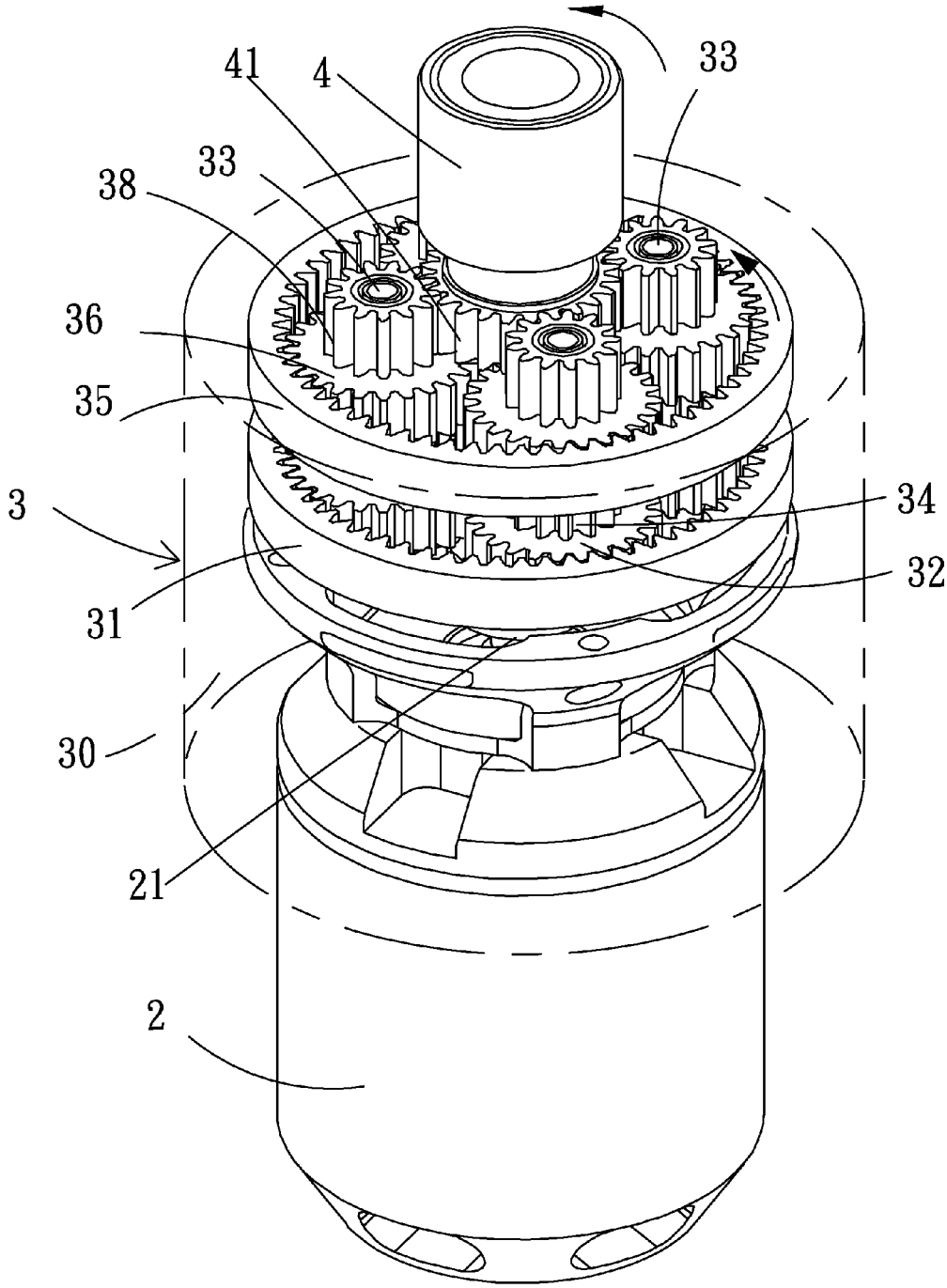
FIG. 3 is a perspective view of major components of a drive mechanism of a model helicopter according to the invention with a main rotor and a substantial portion of a main shaft removed.
Figure 4:
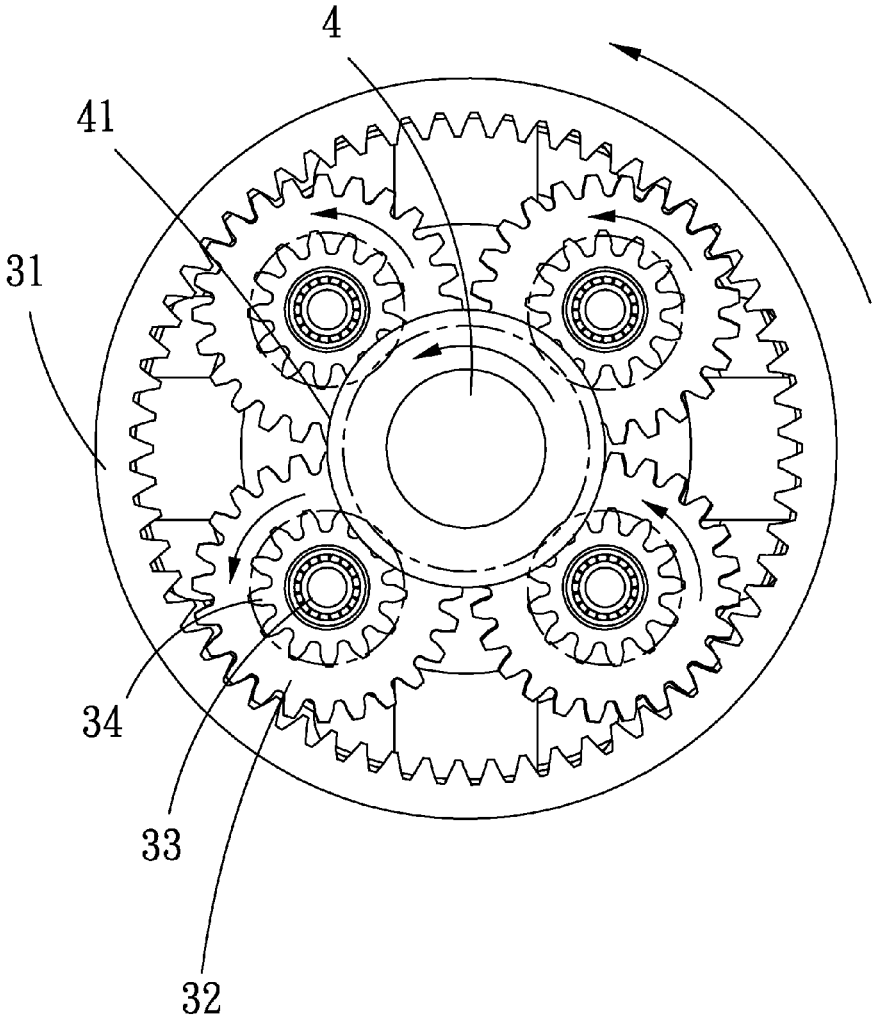
FIG. 4 is a top plan view of a lower section of the reduction gear assembly of FIG. 3.
Figure 5:
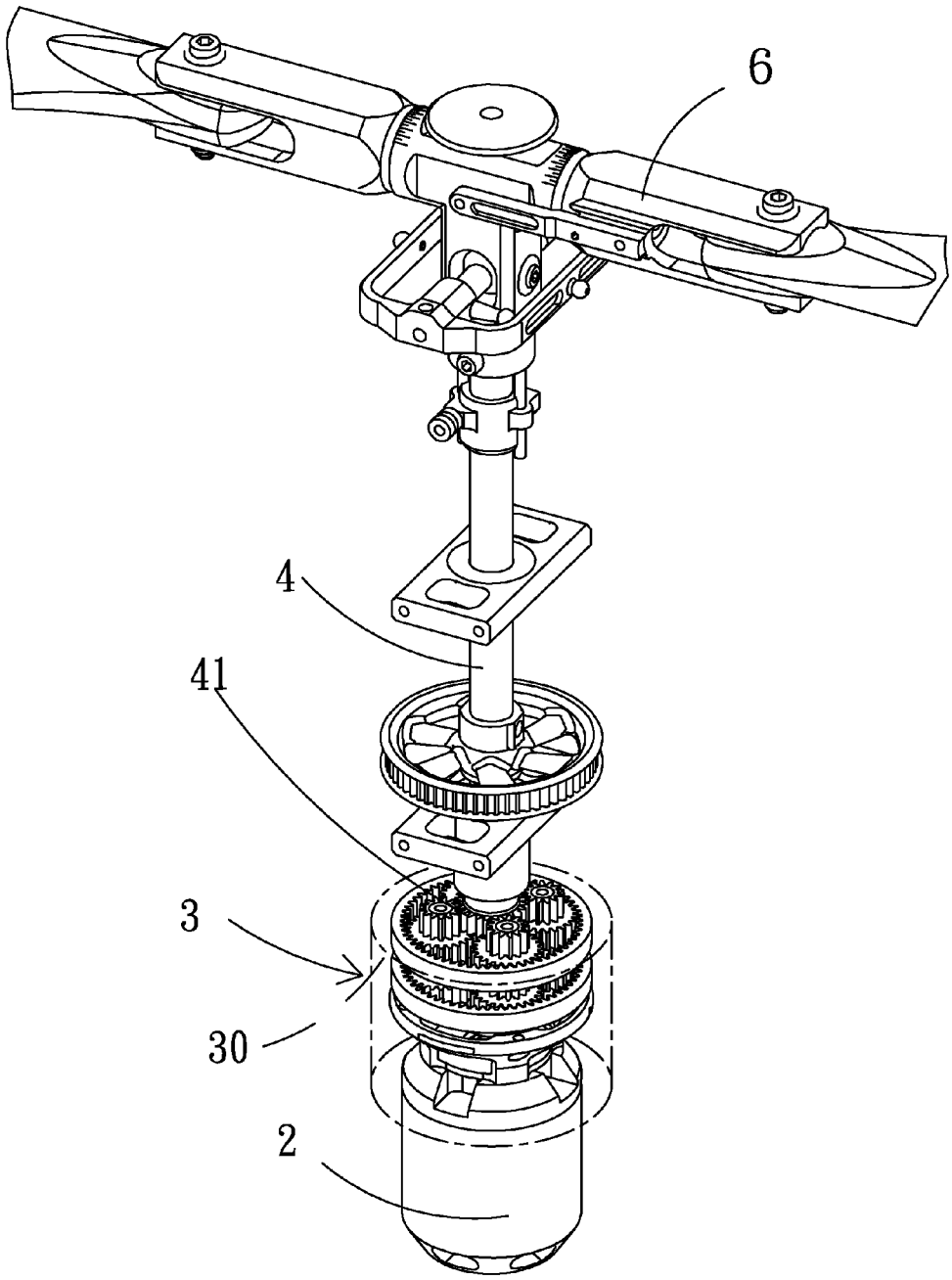
FIG. 5 is a perspective view of the major components of the drive mechanism of the model helicopter according to the invention.

Referring to FIGS. 3 to 5, a drive mechanism of a model helicopter according to the invention is shown. A tail rotor and its associated components are not the subject of the invention and are not shown and described for brevity.

Major components of the drive mechanism comprise a battery powered motor 2 including a toothed motor shaft 21 (only a portion being shown in FIG. 3), and a reduction gear assembly 3. A portion of the motor shaft 21 is disposed in the reduction gear assembly 3. The reduction gear assembly 3 includes a lower section having four large gears (i.e., planet gears) 32 arranged as four corners of a virtual square, four small gears 34 each fixed to top of the large gear 32, and an outer ring gear 31 meshed with the large gears 32; an upper section having four large gears (i.e., planet gears) 36 arranged as four corners of a virtual square, four small gears 38 each fixed to top of the large gear 36, and an outer ring gear 35 meshed with the large gears 36; and four shafts 33 each passing through the upper small gear 38, the upper large gear 36, the lower small gear 34, and the lower large gear 32 at the same corners of the virtual squares and fixed thereto. The large gears 32 of the lower section are meshed with the toothed motor shaft 21 of the motor 2. In FIG. 3, the reduction gear assembly 3 is enclosed by a reduction gear box 30.

It is noted that the cooperating gears (i.e., the large gears 32 and the toothed motor shaft 21) should be bevel gears if the ring gear 31 is bevel gear, and the cooperating gears (i.e., the large gears 36) should be bevel gears if the ring gear 35 is bevel gear.

It is further noted that the number of each of the large gears 32, 36, small gears 34, 38, and shafts 33 can be different from four in other embodiments (e.g., three).

Major components of the drive mechanism comprise further comprise a main shaft 4, a main gear 41 fixed to the main shaft 4 and meshed with the four upper small gears 38, and a main rotor 6 fixed to top end of the main shaft 4 and co-rotated with the large gears 32, the large gears 36, and the small gears 38.

The revolution of the toothed motor shaft 21 of the motor 2 will rotate the main shaft 4 via the lower large gears 32, the upper small gears 38, and the main gear 41. Eventually, the main rotor 6 rotates at the number of revolution determined by the gear reduction ratio of the toothed motor shaft 21 to the large gear 32 and that of the small gear 38 to the main gear 41.

It is envisaged by the invention that maneuverability and stability can be improved, the useful life of components can be prolonged, and energy consumption can be reduced because the motor shaft of the motor is aligned with the main shaft of the main rotor and the provision of the upper and lower epicyclic gearings. Moreover, a desired predetermined gear reduction ratio can be achieved.

While the invention herein disclosed has been described by means of specific embodiments, numerous modifications and variations could be made thereto by those skilled in the art without departing from the scope and spirit of the invention set forth in the claims.

What is claimed is:

1. A model helicopter comprising a drive mechanism, the drive mechanism comprising:

a battery powered motor comprising a toothed motor shaft;

a main rotor comprising a main shaft aligned with the motor shaft, the main shaft including a main gear; and a reduction gear assembly comprising four lower first gears arranged around the motor shaft, a lower outer ring gear meshed with the first gears, four lower second gears each being smaller than the first gear and fixed to top of the first gear, four upper third gears, an upper outer ring gear meshed with the third gears, four upper fourth gears each being smaller than the third gear and fixed to top of the third gear, the fourth gears being meshed with the main gear, and four shafts each axially passing through the fourth gear, the third gear, the second gear, and the first gear so that a revolution of the motor shaft rotates the main shaft via the first gears, the fourth gears, and the main gear.

2. A model helicopter comprising a drive mechanism, the drive mechanism comprising:

a battery powered motor comprising a toothed motor shaft;

a main rotor comprising a main shaft aligned with the motor shaft, the main shaft including a main gear; and a reduction gear assembly comprising three lower first gears arranged around the motor shaft, a lower outer ring gear meshed with the first gears, three lower second gears each being smaller than the first gear and fixed to top of the first gear, three upper third gears, an upper outer ring gear meshed with the third gears, three upper fourth gears each being smaller than the third gear and fixed to top of the third gear, the fourth gears being meshed with the main gear, and three shafts each axially passing through the fourth gear, the third gear, the second gear, and the first gear so that a revolution of the motor shaft rotates the main shaft via the first gears, the fourth gears, and the main gear.

* * * * *